US005503526A

United States Patent [19]

Neils et al.

[11] Patent Number: 5,503,526

[45] Date of Patent: Apr. 2, 1996

[54] FIRE FIGHTING FAN WITH THREE POINT SUPPORT

[76] Inventors: John J. Neils; James L. Neils, both of W. 3645 Hollister Hills, Post Falls, Id. 83854

[21] Appl. No.: 376,752

[22] Filed: Jan. 23, 1995

[51] Int. Cl.[6] ..... F04D 29/64

[52] U.S. Cl. ..... 416/63; 416/246; 417/234; 169/52; 169/91; 248/188.5

[58] Field of Search ..... 416/63, 246, 247 R; 417/234; 169/52, 91; 248/168, 170, 188.5, 188.9

[56] References Cited

U.S. PATENT DOCUMENTS

| | | | |
|---|---|---|---|
| 1,972,654 | 9/1934 | Heath | 416/63 |
| 2,215,035 | 9/1940 | Gundelfinger | 416/246 |
| 2,884,075 | 4/1959 | Poon . | |
| 2,891,624 | 6/1957 | McBride . | |
| 3,004,612 | 10/1961 | Kofahl . | |
| 3,685,300 | 8/1972 | Mott et al. . | |
| 4,402,487 | 9/1983 | Donnelly . | |
| 4,886,233 | 12/1989 | Bateman et al. . | |
| 4,906,164 | 3/1990 | Jackman et al. | 416/63 |
| 4,976,319 | 12/1990 | Eberhardt et al. . | |
| 5,012,214 | 5/1991 | Kapich . | |
| 5,062,487 | 11/1991 | Siria et al. . | |
| 5,152,578 | 10/1992 | Kiguchi . | |
| 5,205,711 | 4/1993 | Raczykowski . | |
| 5,395,087 | 3/1995 | VanBasten | 416/63 |

*Primary Examiner*—Edward K. Look
*Assistant Examiner*—James A. Larson
*Attorney, Agent, or Firm*—Keith S. Bergman

[57] ABSTRACT

A portable, positive pressure fan for fire fighting provides a three-leg frame with a platform supporting the fan and its driving engine. The platform carries two forward, laterally spaced collars and one rearward collar to adjustably receive the three legs for support spacedly above a supporting surface. The legs are adjustably positionable in the collars to allow vertical adjustment to regulate fan height and angulation relative to a supporting surface, have an arcuate configuration and are somewhat resilient to absorb and damp operative forces, and the leg array alleviates or negates walking of the structure on a supporting surface caused by vibrations resulting from operational forces. The fan has a blade with diametrically opposed lobes of the aircraft propeller type to create a narrow cone of pressurized air and preserve as great a volume and velocity of such air as possible at ordinary operating distances.

6 Claims, 3 Drawing Sheets

43
26
42
12
38
41
13
24
37
39
40
16
17
22
35
36
19
46
23
21
27
10
14
21
32
22
23
20
18
19
11
25
11
24
10
22
20
32
32
23
28
33
34
34
32
11

FIRE FIGHTING FAN WITH THREE POINT SUPPORT

BACKGROUND OF INVENTION

IIA. RELATED APPLICATIONS

There are no applications related hereto heretofore filed in this or any foreign country.

IIB. FIELD OF INVENTION

This invention relates generally to portable self-powered fire fighting fans, and more particularly to such a fan that has three-legged support, allows height and angulation adjustment and delivers a narrow cone of pressurized air at working distances.

IIC. BACKGROUND AND DESCRIPTION OF PRIOR ART

Fans have long been used in fire fighting, in their early history primarily for ventilation and to create back draft and in their more recent: history especially to create a positive pressure within a burning structure. As the use of fire fighting fans has evolved, their structures have become more complex to meet their functional demands, until at the present time they are: quite sophisticated. Notwithstanding this developmental history, known self-powered portable fire fighting fans still present operational problems, some of which the instant invention seeks to resolve or lessen.

Most prior fire fighting fans have provided fan support closely above a supporting surface and generally have provided either no means for height adjustment or provide only limited height adjustment. This makes such fans somewhat easier to support and more stable in their support, but creates other problems. Often it is desired to provide a horizontally oriented stream of pressurized air at a fairly substantial distance above a surface supporting a fire fighting fan, especially to prevent the disturbance and transport of various debris supported on the earth and to properly direct the fan's pressurized air stream into a structure orifice. The instant invention solves this problem by providing a fan platform supported by plural legs which may be independently adjusted to regulate the height of the platform above a supporting surface. The length of these allows substantial elevation of a fan, above that allowed by other present day fans, while still providing for fan stability and positional maintenance during operation and without increasing the mass of the instant fan above that of other fans of similar power.

It is necessary for practical utility that a fire fighting fan be adjustable in the vertical angulation of its output stream relative to the surface supporting the fan and many prior fans have recognized this: requirement. Most such prior fans, however, have provided vertical angular adjustment by means of separate, often complex structures. In distinguishment, the instant fan provides vertical angular adjustment of its pressurized air stream by differential adjustment of the length of the legs supporting the fan platform to provide a simple adjustment structure that serves the dual purpose of both height and angulation adjustment and one that does not depend upon the relatively mechanically delicate pivotal motion of one portion of the fan support structure relative to another.

The so-called "walking" or motion of fire fighting fans relative to a supporting surface that is caused by their operation, and especially vibration and reactive and torquing forces, has been an ever present problem with such devices.

The instant fan substantially resolves this problem by providing support of the fan structure on three depending legs. Each leg is of an arcuate, outwardly and downwardly flaring configuration to provide support points substantially further apart than the size of the fan support platform carrying them. The arcuate configuration and semi-resilient nature of the legs also allows them to serve as shock absorbers and dampening means, while yet providing appropriate rigidity to positionally maintain the fan The legs are arrayed with two extending in a forward direction and one in a rearward direction, as opposed to prior fans having either s rearward, transverse bar-type support or multiple legs, either more than three or otherwise arrayed, which tend to promote rather than reduce walking because of the reactive force on the fan structure caused by the forward thrust of its pressurized air stream synergistically combined with its operational vibrations.

The particular structure of the support legs provides secondary advantages. To aid compaction of our fan for storage, the legs may be moved upwardly relative to the support platform so that the total vertical height of the fan is substantially one-half of its height in its operative mode. The fan is completely operative with the legs either fully extended or fully retracted.

The three point type of support provided by the legs of the instant structure provides secondary advantages in that they allow the straddling of various obstacles on the ground and allows placement on uneven ground which would not support a four-legged fan or one having rigid bars forming its supporting surface. The particular leg structure also allows placement of the fan on uneven and angulated structures such as on stairs.

As the legs are lengthened and the fan consequently raised further above a supporting surface, the fan acts through a longer lever arm to tend to destabilize fan support. At the same time, however, the distance between the lower ends of the legs becomes greater because more stability in the support and teds to counteract the negative effect of raising the fan.

The instant fan provides a two lobe, propeller type blade that curves forwardly to create s relatively narrow cone of pressurized air, as opposed to prior fire fighting fans that have created relatively wide angled output cones The theory of such wider cones of air is to seal the area about a structural orifice with pressurized air to create a positive pressure within a structure, but it has been found that such wide cones waste the energy of much of the pressurized air that the fan creates and the so-called "sealing" of orifices through which the air is introduced appears to accomplish little if anything of value. The purpose of positive air pressure in modern fire fighting theory is to remove gaseous debris from a somewhat contained combustion area, and the pressure is effective to remove such material through an input orifice as well as through any other orifice in s structure. The instant fan therefore, in distinguishment from prior fans, provides a relatively narrow cone of pressurized air that may be more effectively directed through a structural orifice from a greater distance to create more ventilating energy within the structure than would a fan of similar power using a wider output cone.

Our invention resides not in any one of these features per se, but rather in the synergistic combination of all of the structures of our fan that necessarily give rise to the functions flowing therefrom as herein specified and claimed.

III. SUMMARY OF INVENTION

Our fan provides a frame having an engine mounting plate carrying two forward and one rearward leg support collars that adjustably carry arcuately configured, outwardly extending legs for slidable positioning therein. The rearward leg collar extends spacedly above the engine mounting plate to provide a handle, extending over the top of the engine carried on the mounting plate, to aid manipulation, and each collar provides screw fasteners to adjustably maintain the positioning of an associated leg therein. The engine mounting plate carries an internal combustion engine that powers a forwardly extending fan blade carried in a protective cage. The fan blade is of a two lobe aircraft propeller type that creates a relatively narrow output cone of pressurized air directed parallel to the engine mounting plate. The arcuate legs of the frame are formed of resilient material, that when coupled with the leg configuration serve as shock absorbers and vibration dampeners.

In providing such apparatus, it is:

A principal object to provide a portable adjustable, fire fighting fan that has three point support on an underlying surface and allows positioning of a fan substantially above that supporting surface.

A further object is to provide such a fan that has three arcuate, outwardly extending legs that adjustably depend from a mounting plate to allow adjustable vertical positioning of a fan and adjustable vertical angulation of the fan to adjust the vertical orientation of the output cone of a fan blade.

A further object is to provide such a fan that has two legs mounted to extend in a forward direction and one leg mounted to extend in a rearward direction with the legs being formed of somewhat resilient material so that their nature, array and configuration tend to prevent or lessen walking of the fan on a supporting surface during operation, and allow positioning on rough and irregular surfaces.

A still further object is to provide such a fan that has a two lobe aircraft type blade that creates a relatively narrow cone of pressurized air output to allow more of that output to enter an orifice of a structure and allow positioning of the fans at a greater distance from that orifice to permit easier access both to the fan and the structure being serviced by it, without excessively disturbing ground debris.

A still further object is to provide such a fan that is of new and novel design, of rugged and durable nature, of simple and economic manufacture and one otherwise well adapted to the uses and purposes for which it is intended.

Other and further objects of our invention will appear from the following specification and accompanying drawings which form a part hereof. In carrying out the objects of our invention, however, it is to be remembered that its accidental features are susceptible of change in design and structural arrangement, with only one embodiment of the best known mode being illustrated in the accompanying drawings as is required.

IV. BRIEF DESCRIPTION OF DRAWINGS

In the accompanying drawings which form a part hereof and wherein like numbers of reference refer to similar parts throughout:

V. DESCRIPTION OF THE PREFERRED EMBODIMENT

Figure 1:
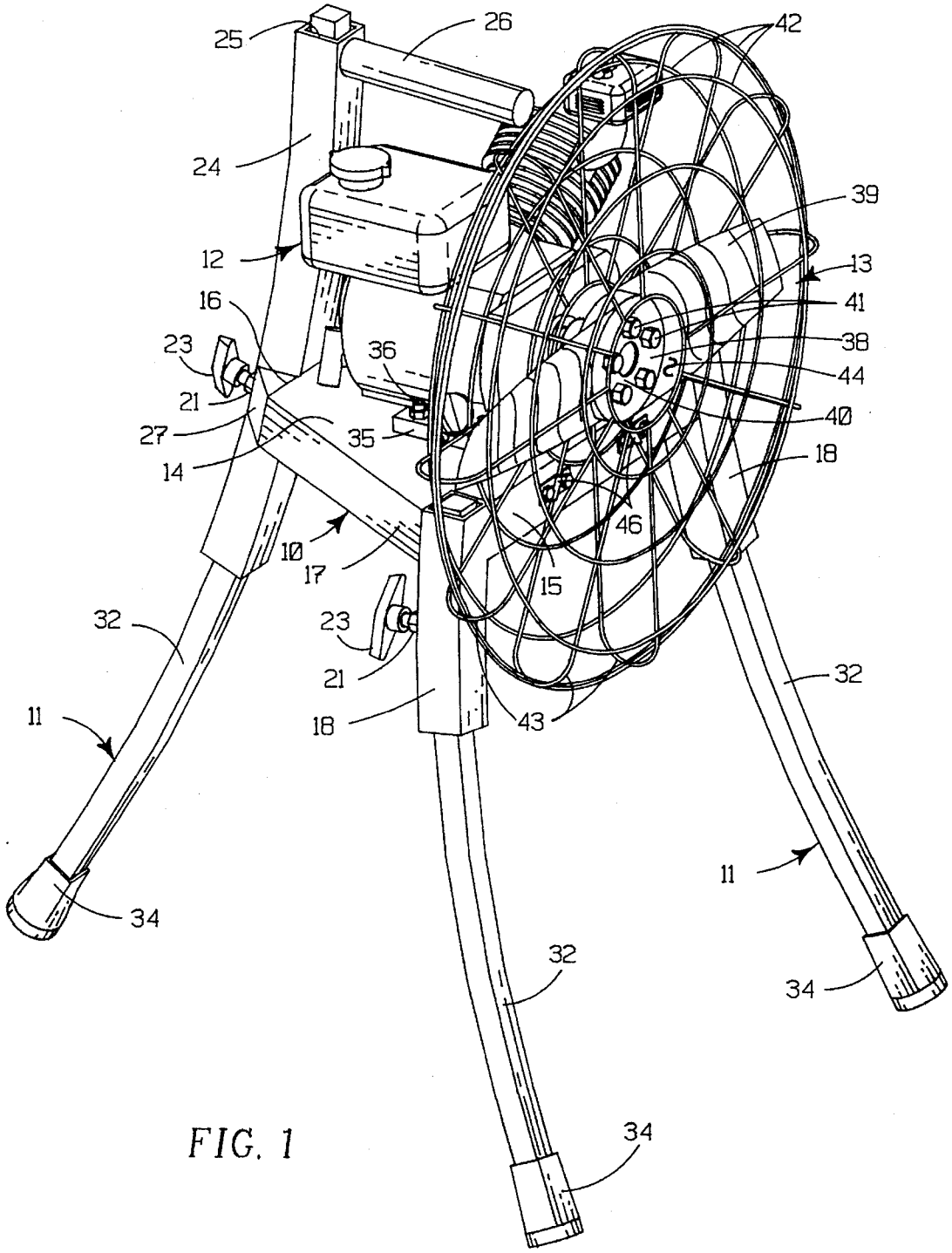
FIG. 1 is an isometric elevational view of our fan showing its various parts, their configuration and relationship.
Figures 2, 4:
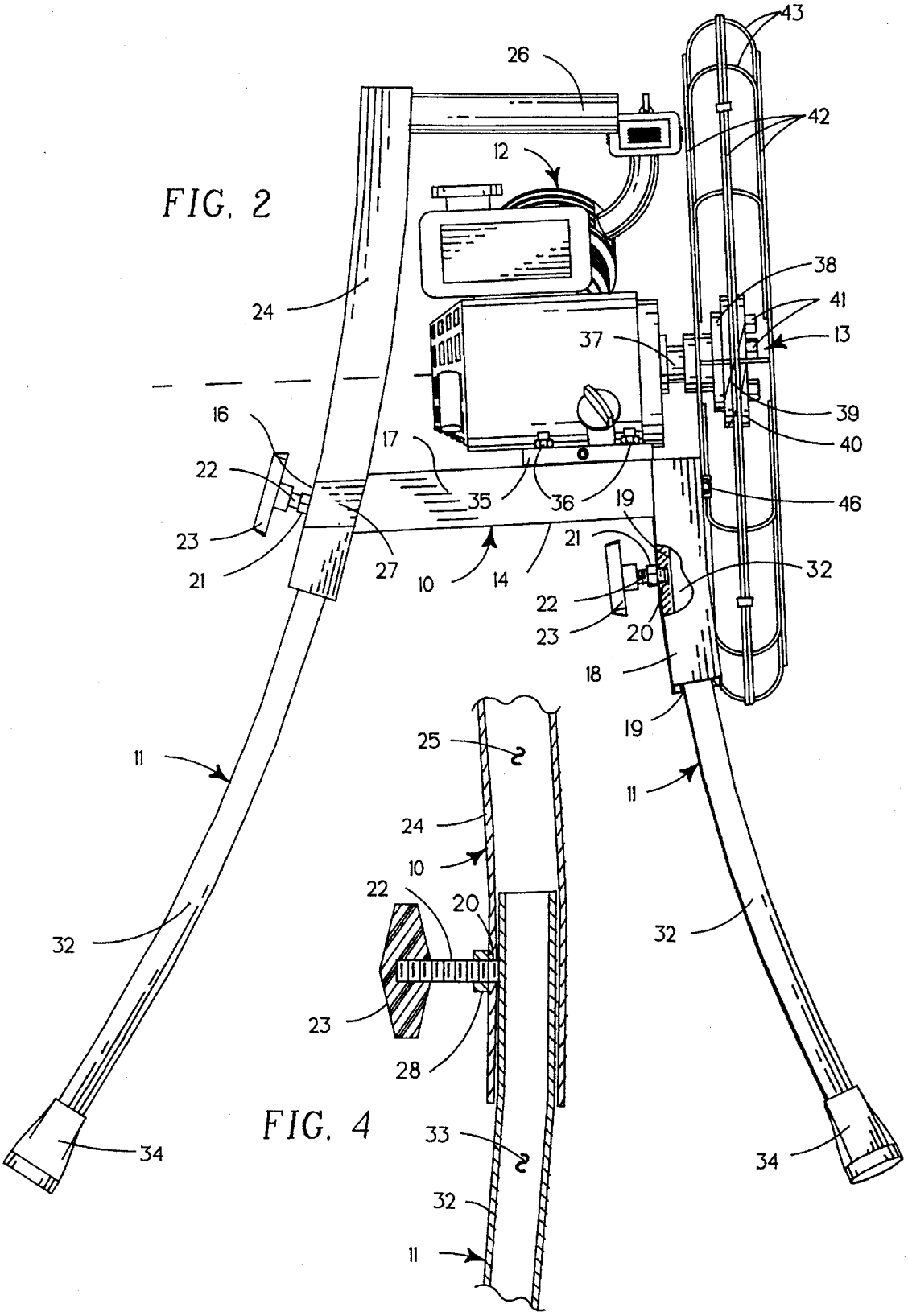
FIG. 2 is an orthographic side view taken from the left side of the fan of FIG. 1.
FIG. 4 is an enlarged partial cross-sectional view of the structure fastening a leg within a leg collar, taken on the line 4—4 of FIG. 3 in the direction indicated by the arrows thereon.
Figure 3:
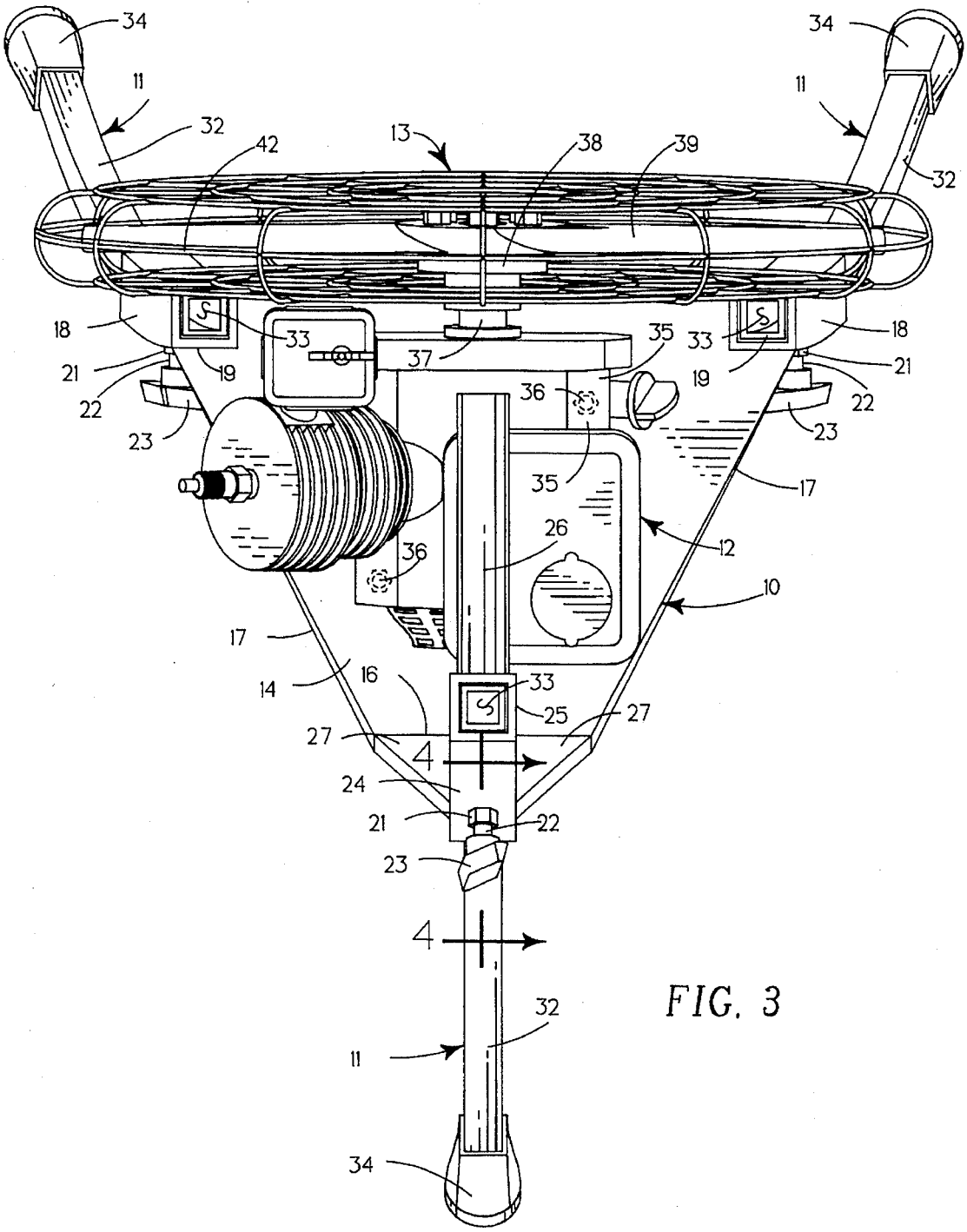
FIG. 3 is an orthographic top view of the fan of FIG. 1.

Our invention generally provides frame 10 supported by legs 11 and carrying engine 12 and fan 13 spacedly above a surface supporting its legs.

Frame 10 provides trapezoidal engine support base 14 having longer, laterally extending forward edge 15 and shorter, parallel, laterally extending rearward edge 16 joined by angulated side elements 17. The lateral portions of the forward edge of the engine support base define notches wherein forward leg support collars 18 are structurally carried. The forward leg support collars each define internal channel 19, in the instance illustrated of square cross-sectional shape, to slidably receive a leg for vertical motion therein. Each forward leg support collar is of an arcuate configuration to slidably accept an arcuate forward leg. Each collar depends below the support base a distance substantially equal to that of the dependency of a fan blade cage that is supported on the support base. Each forward leg support collar 18 defines fastening bolt hole 20 in a vertically medial position, with an associated nut 21 thereover structurally carried by the adjacent rearward facing surface of the support collar to threadedly receive adjustment bolt 22, having enlarged head 23 to aid manual manipulation, to extend into the medial channel 19 to fastenably position a leg carried in the medial channel.

Rearward leg support collar 24 is a similar tubular element defining medial channel 25 extending therethrough to slidably receive a rearward leg. The rearward leg support collar, however, is somewhat longer and extends spacedly above engine support base 14 to carry a handle 26 extending forwardly over the support base at a vertical position above an engine carried thereon so as not to interfere with that engine but yet provide means to aid manual manipulation of the fan structure. The rearward leg support collar 24 is structurally carried in a medial position on the shorter rearward edge 16 of the support base, and this interconnection is strengthened by two similar filets 27 carried on each side of the support collar to extend from that collar into structural communication with the adjacent rearward edge of the support base. The rearward support collar 24 is of a curvilinear configuration to accept a curvilinear rearward leg and allow that leg to adjustably extend in the medial channel of the collar. The rearward leg support collar defines fastening bolt hole 20, in the instance illustrated at the level of the support base, and this hole has an associated adjustment bolt nut 28 thereover structurally carried by the adjacent rearward facing surface of the support collar. The nut 28 threadedly carries adjustment bolt 22, again having enlarged head 23 to aid manipulation and extending into the channel 25 of the rearward leg support collar to positionally maintain a rearward leg in the medial channel.

Legs 11 all provide similar elongate tubular body elements 32, in the instance illustrated, each leg having an outer cross-sectional shape similar to and incrementally smaller than the square cross-sectional shape of the medial-channels 19, 25 of the leg support collars. Preferably the tubular leg elements define medial channels 33 to lessen the overall weight of the structure and aid in providing the resilience required of the leg elements. Each leg is formed with similar srcuste axial configuration that is a portion of a circular arc so that the leg may move within the channel of the leg collars which have similar arcuate configuration. This arcuate configuration of the legs allows them to extend downwardly away from the engine support base to provide a greater distance between the depending ends of the legs than exists between their upper portions carried by the leg support collars to provide more stability of support for the structure. The arcuate configuration defined by the square tubular elements also provides more shock absorbency and better dampening resilience than is provided by legs of other cross-sectional shapes and configurations. Other leg shapes and configurations, especially s straight leg extending in an angulated fashion, are within the ambit and scope of our invention and, though they may not provide the maximum of efficient operation, they are operationally feasible.

The lower end portions of each leg carries a foot 34 formed of resilient material to prevent entry of debris into the channel defined by the leg elements and provide better frictional support on a supporting surface. The length of the legs is not critical, but preferably is such as to allow positioning of the fan over a vertical extent greater than approximately eighteen inches. With this leg structure, is to be noted that the legs may be fully retracted into a compact mode with the feet 34 immediately below the lower portion of leg support collars 18, 24, but yet may be extended at least 24 inches downwardly from that compact mode for operational use.

Engine 12 is an internal combustion engine of commerce. The engine provides base plate 35 defining mounting bolt holes (not shown) extending therethrough to receive nut-bolt fasteners 36 that extend through those holes and through appropriately positioned holes defined in the support base to rigidly, but releasably, fasten the engine on the upper surface of the support base 14. The engine provides powering shaft 37 extending therefrom in a forward direction parallel to the mounting plate. This shaft 37 in its forwardly extending, outward end portion carries flange-type coupling 38 that mounts the fan blade thereon. The fan blade coupler 38 defines plural fastening holes (not shown) to receive bolts 41 that extend through and releasably fasten a fan propeller. The vertical extent of engine 12 is such that none of the engine components interfere with handle 26 carried by the rearward support collar 24. It is possible that our fan could be powered by an electrical motor, but normally such powering is not desired in fire fighting fans because electricity commonly is not available where the fans are used and if it is available, it presents dangers in use by reason of the wet environs in which fire fighting fans commonly are used.

Fan structure 13 provides elongate fan blade 39 having central hub 40 defining spaced fastening holes (not shown) that cooperate with the fastening holes defined in fan blade coupling 38 to receive bolts 41 therebetween for releasable fastening of the fan blade on the fan blade coupling. Fan blade 39 is configured with symmetrical curvature in each of its arms that prevents as much slippage of air as possible from the outer ends of the fan blade to create a relatively narrow exit cone of air pressurized by the fan. The general theory of fire fighting fan blades has heretofore been developed in the aircraft industry and such blades are available in present day commerce. In general such blades are of a fairly narrow nature, have s relatively shallow pitch and operate at a relatively high speed to accomplish their ends. Fan blades of such nature should have an air output of twelve to twenty thousand cubic feet per minute when operated in the lower range by a three-horse power motor and in the upper range by a four-horse power motor, with rotary speeds approximating two thousand six hundred revolutions per minute.

The fan blade 39 is enclosed in an oblately spheroidal protective cage peripherally formed with two similar interconnected halves by concentric wire rings 42 and radially extending wire 43. These rings and loops are joined at some or all of their intersections to form a rigid structure for interconnection about their peripheries to define an internal chamber within which the fan blade 39 may unobstructedly rotate. The medial portions of the fan blade cage 42, 43 define holes 44 to allow passage of the engine powering shaft 37 and couplers 38, 40 and access to bolts 41 which mount the fan blade between the fan blade couplers. The fan cage is structurally supported on the forward edge of engine support base 14, in the instance illustrated by brackets 46 releasably carried on the support base, though other fastening means are within the ambit and scope of our invention.

Having thusly describe the structure of our fan, its operation may be understood.

A fan, constructed according to the foregoing specification, before use will normally be in its compact storage mode, with legs 11 moved to their uppermost extension so that feet 34 are immediately below the lower portions of the leg support collars 18, 24 carrying them. The fan in this condition is grasped by handle 16 and moved to the location where it is to be positioned.

The adjustment bolts 22 that positionally maintain the legs in their associated support collars are then sequentially loosened and the legs moved downwardly to a position which provides the desired height for the fan when supported on the legs. As each leg is moved to this position of the support mode, the associated adjustment bolt 22 is tightened to positionally maintain the leg in its associated support collar. The fan structure then is moved to its upright operative position, if it should be otherwise disposed, and the engine 12 is started in its normal fashion to commence rotary operation of the fan blade 39.

If it be desired to use the fan in a horizontal orientation, all support legs are moved with their feet at a substantially equal distance beneath the support base 14 and with appropriate extension to establish the desired vertical position.

If it be desired to angulate the fan from a vertical position that produces a horizontal output cone, the rear leg is adjusted in length relative to the front legs to create an upward angulation of the support base by shortening its dependency below the support base and a downwardly angulation of the support base is accomplished by lengthening its dependency below the base. If a fan is to be positioned on a sloping or irregular surface, the legs may be differentially positioned to provide support with appropriate angulation of the support base. If desired, all three legs may be positioned to angulate the base so that no one of its edges are horizontal, though there normally is no purpose for such positioning of a fire fighting fan.

After use, the fan engine is shut off and the fan returned to its storage mode by reversing the procedure outlined for establishment of the operative mode.

The foregoing description of our invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described our invention, what we desire to protect by Letters Patent, and

What we claim is:

1. A fire fighting fan comprising in combination:

a frame having an engine support base with two spaced forward leg support collars and one spaced rearward leg support collar, each support collar having means for adjustably positioning a leg therein;

elongate outwardly extending legs slidably carried in each support collar;

an engine carried on the engine support base, said engine having a forwardly extending drive shaft;

a fan blade irrotatably carried by the drive shaft of the engine spacedly forward of the engine support base; and a fan cage supported by the engine support base and extending about the fan blade to allow rotation thereof.

2. The fire fighting fan of claim 1 wherein each leg support collar is a tube defining a medial channel and having an axis formed as a circular arc, and each leg has a cross-sectional shape incrementally smaller than and similar to the cross-sectional shape of the medial channel of its associated leg support collar and an axis formed as a circular arc that is the same as the circular arc defining the axis of the associated leg support collar.

3. A fire fighting fan, comprising in combination:

a frame having an engine support base carrying two spaced depending forward leg support collars and a depending rearward leg support collar positioned spacedly rearwardly of the forward leg support collars and between the forward support collars, each support collar defining a medial channel having an arcuate axial configuration to extend spacedly outwardly and downwardly from the engine support base, and having adjustment means to releasably position a leg therein; an elongate leg carried by each support collar, each said leg having an arcuate configuration similar to that of the medial channel of the support collar carrying the leg to allow extension within the channel of that support collar, and a cross-sectional shape similar to and incrementally smaller than the cross-sectional shape of the medial channel of the support collar carrying the leg for sliding motion to allow adjustable positioning of the leg relative to the associated support collar; an engine supported on the engine support base; and a fan having a blade, supported and powered for rotation by the engine, carried in a fan cage supported by a forward portion of the engine support base.

4. The fire fighting fan of claim 3 wherein the rearward support collar extends spacedly above the engine support base and carries a handle extending over the engine support base and the engine carried thereon to aid manual manipulation of the fire fighting fan.

5. The fire fighting fan of claim 3 further characterized by the length of each leg being greater than eighteen inches, and. each leg carrying a resilient foot in its lower end portion.

6. The fire fighting fan of claim 3 further characterized by:

the adjustment means for adjustably maintaining the legs in the leg collars comprising fastening bolts extending in threaded engagement through holes defined in the leg support collars and into the channel defined therein.

* * * * *